US009902910B2

(12) United States Patent
Akrour

(10) Patent No.: US 9,902,910 B2
(45) Date of Patent: Feb. 27, 2018

(54) CRUDE OIL EMULSION TREATING APPARATUS AND METHOD

(75) Inventor: Fatiha Akrour, Calgary (CA)

(73) Assignee: AKER PROCESS SYSTEMS AS, Lysaker (NO)

( * ) Notice: Subject to any disclaimer, the term of this patent is extended or adjusted under 35 U.S.C. 154(b) by 995 days.

(21) Appl. No.: 14/122,475

(22) PCT Filed: May 31, 2012

(86) PCT No.: PCT/IB2012/052742

§ 371 (c)(1),
(2), (4) Date: Mar. 24, 2014

(87) PCT Pub. No.: WO2012/164520

PCT Pub. Date: Dec. 6, 2012

(65) Prior Publication Data

US 2014/0216983 A1 Aug. 7, 2014

(30) Foreign Application Priority Data

May 31, 2011 (NO) ..... 20110790

(51) Int. Cl.

| | |
|---|---|
| ***C10G 31/06*** | (2006.01) |
| ***C10G 33/08*** | (2006.01) |
| ***C10G 33/00*** | (2006.01) |

(52) U.S. Cl.

CPC ..... *C10G 31/06* (2013.01); *C10G 33/00* (2013.01); *C10G 33/08* (2013.01);
(Continued)

(58) Field of Classification Search

CPC .... C10G 2300/1033; C10G 2300/4006; C10G 2300/4012; C10G 31/06; C10G 33/00; C10G 33/08

See application file for complete search history.

(56) References Cited

U.S. PATENT DOCUMENTS 4,814,044 A 3/1989 Hitt
4,995,495 A 2/1991 Krynski
(Continued)

FOREIGN PATENT DOCUMENTS

CA 2179760 1/2001

OTHER PUBLICATIONS

International Search Report dated Sep. 11, 2012 in International Application No. PCT/IB2012/052742.
(Continued)

*Primary Examiner* — Cabrena Holecek
(74) *Attorney, Agent, or Firm* — Wenderoth, Lind & Ponack, L.L.P.

(57) ABSTRACT

A method and apparatus a crude oil treating apparatus includes a treating section and a flashing section connected together by a pipe and a flashing valve. The method includes the steps of passing wet crude oil into the treating section; separating water from the wet crude oil in the treating section; obtaining partially dry crude oil; passing the partially dry crude oil via the pipe and the flashing valve to the flashing section of the apparatus; heating the partially dry crude oil upstream of the flashing section and downstream of the flashing valve by heat exchange with the water separated from the crude oil in the treating section; and obtaining dry crude oil from the flashing section.

5 Claims, 1 Drawing Sheet

(52) U.S. Cl.
CPC ..... *C10G 2300/1033* (2013.01); *C10G 2300/4006* (2013.01); *C10G 2300/4012* (2013.01)

(56) References Cited

U.S. PATENT DOCUMENTS 5,707,510 A * 1/1998 Berry ..... C10G 33/06 196/111
5,900,137 A * 5/1999 Homan ..... B01D 17/005 175/206

OTHER PUBLICATIONS

Written Opinion of the International Searching Authority dated Sep. 11, 2012 in International Application No. PCT/IB2012/052742.
International Preliminary Report on Patentability dated Jul. 11, 2013 in International Application No. PCT/IB2012/052742.

* cited by examiner

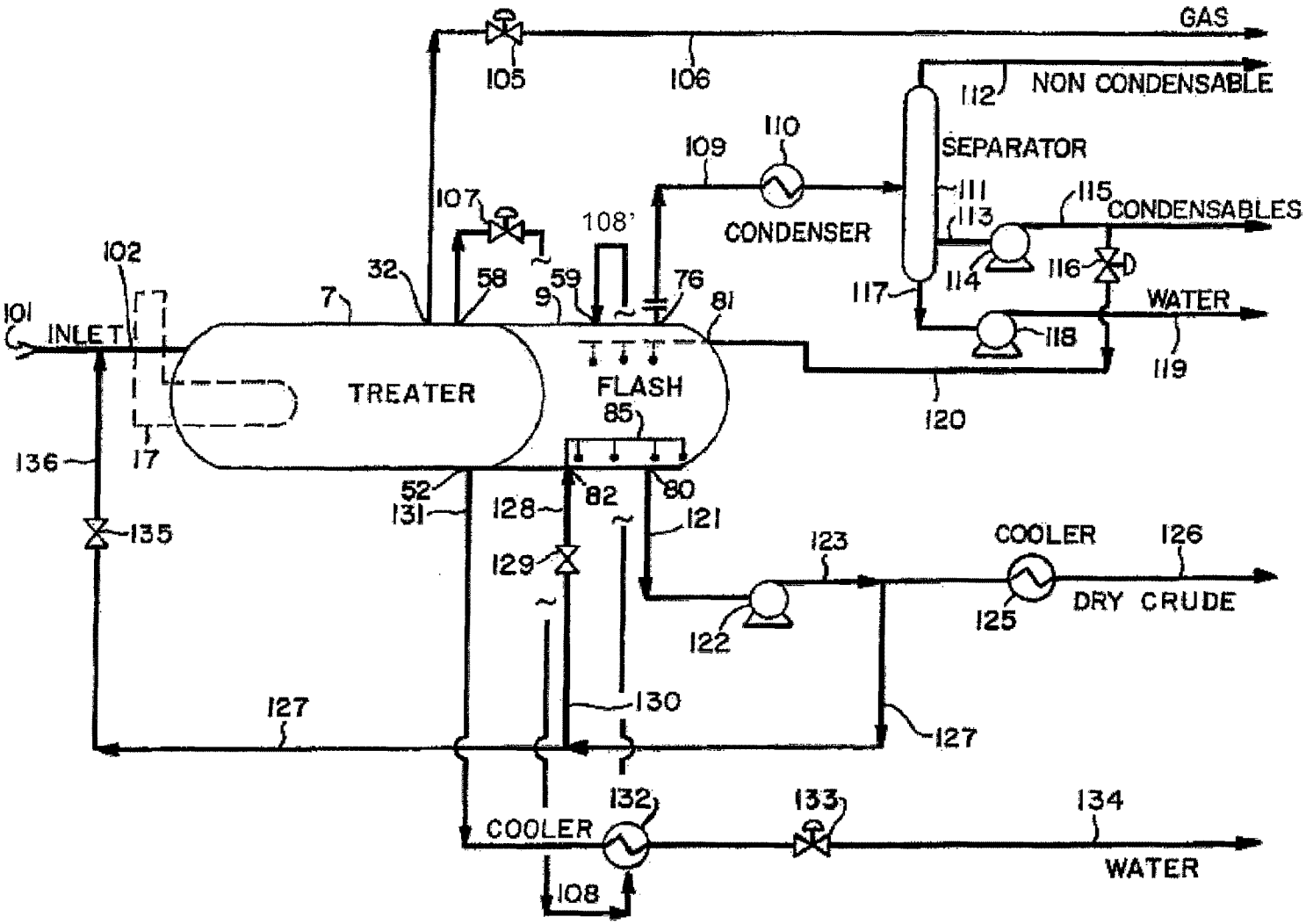
GAS
NON CONDENSABLE
CONDENSABLES
WATER
DRY CRUDE
WATER
SEPARATOR
CONDENSER
COOLER
COOLER
FLASH
TREATER
INLET

CRUDE OIL EMULSION TREATING APPARATUS AND METHOD

BACKGROUND OF THE INVENTION

Field of the Invention

The present invention relates to an apparatus and a method for crude oil emulsion treatment and in particular to an apparatus and method with improved flexibility of flash treatment of crude oil, especially crude oil with high water content.

Background of Related Art

The present invention relates to separation of crude oil into mainly gas, dry crude and water.

U.S. Pat. No. 5,707,510 and Canadian Patent 2,179,760 describe an invention to improve the efficiency and reliability of flash treating crude oil. The treating apparatus and method disclosed on FIGS. 2 & 3 of the patents eliminated the need of a fired heater in the flashing section when the water cut associated with slop oil/rags is low (about 5 to 10 volume %). By using only immersed fire tubes or coils in the heating/treating section of the Slop Treater, the slop oil/rag is dehydrated to specifications.

In U.S. Pat. No. 5,707,510 as well as in related art, the treater section is a conventional heavy oil treater which utilized heat addition; mechanical coalescing to gravity separate most of the water and solids from the slop oil/rag. Here the emulsion is heated under pressure to a temperature such that when the slop oil/rag and residual water are discharged from the treating and throttled down across a control valve to near atmospheric pressure in the flash section. A portion of the sensible heat of the hot crude/water mixture is converted to latent heat of vaporization that turns the water into vapour as the mixture depressurizes across the control valve 107. The crude/water mixture cools as the energy is absorbed by the vaporising water. The amount of temperature reduction depends on the amount of water evaporated. In the solution according to U.S. Pat. No. 5,707,510, the operating temperature of the treater section must be high enough that the resulting temperature in the flash section is above the boiling point for water for the operating pressure in the flash section to ensure that all the water will vaporise to steam. Here the heating means in the treating section provides all the heat required for the flash section to operate.

In U.S. Pat. No. 5,707,510 the premise is that the water content in the slop oil entering the treating section is less than 10% and, the partially dehydrated slop oil/rag leaving the treating section will contain small amounts of water (3 to 4 volume %). However with the production of ultra heavy oils and bitumen from oil sands using steam assisted gravity drainage (SAGD) or Fire Floor techniques, water contents of 10 to 50% volume and higher in the slop oil and rags are not uncommon requiring greater heat duties in the treating section of the Slop Treater.

These new production techniques require removing continuously the rags directly from process separation equipment.

The residual amounts of water in the partially dehydrated slop oil/rag leaving the treating section can not be reduced to less than 4 volume % in the method according to U.S. Pat. No. 5,707,510.

As explained in U.S. Pat. No. 5,707,510 much of the water is separated by gravity in the treating section and is discharged from the vessel by outlet 52 and outlet line 131. In U.S. Pat. No. 5,707,510 this discharge water is then cooled by cooler 132 using an independent cooling medium.

SUMMARY OF THE INVENTION

The aim of the present invention is to provide a method for treating slop oil/rag with high water content, and to provide equipment for performing this method. Especially the aim is to provide a method adaptable to treating slope oil/rag from a SAGD process containing ultra heavy oils, bitumen and large amounts of water.

Another aim is to provide a flexible system applicable to use with a range of different water contents.

Yet another aim is to provide a solution wherein the size of the treater section may be reduced.

A further aim is to provide a method which is energy efficient under these circumstances.

It is also an aim to provide a method and system without the need for heating in the flashing section.

One aspect the present invention provides a method for operating a crude oil treating apparatus comprising a treating section and a flashing section connected together by a pipe and a flashing valve, comprising the steps of:

- passing wet crude oil into the treating section;
- separating water from the wet crude oil in the treating section;
- obtaining partially dry crude oil;
- passing partially dry crude oil via the pipe and the flashing valve to the flashing section of the apparatus;
- heating the partially dry crude oil upstream of the flashing section and down stream of the flashing valve by heat exchanged with the water separated from the crude oil in the treating section; and
- obtaining dry crude oil from the flashing section.

In one embodiment of the method according to the present invention the method further comprises returning a part of the obtained dry crude oil to the flashing section.

In another embodiment the method further comprises returning a part of the obtained dry crude oil to the treating section.

In yet another embodiment of the method according to the present invention all heat for the flashing section is provided by heating the partially dry crude oil upstream of the flashing section.

In one aspect of the method according to the present invention the crude oil has a water content within the range 5-50 volume %, preferably 11-50 volume % or 15-50 volume % and in another aspect the crude oil has a water content higher than 50 volume %. Accordingly the present method is applicable to crude oils with a water content of between 5-90 volume %, as well as 11-80 volume %, 15-75 volume %.

In another embodiment of the method according to the invention the partially dry crude oil leaving the treating section has a water content within the range 5-10 volume %.

The present invention further provides an apparatus for treating crude oil comprising:

- a treating section comprising a wet crude oil inlet, a gas outlet, a water outlet, a partially dry crude outlet and at least one fired heater tube;
- a flashing section without heating means comprising a partially dry crude inlet, a dry crude outlet, and a vapor outlet;
- a flashing valve and a heat exchanger arranged on a pipe connecting the partly dry crude outlet with the partly dry crude inlet, wherein the said water outlet is in fluid communication with the heat exchanger.

In one aspect of the present invention the flash section further comprises a dry crude recycle inlet in fluid communication with the dry crude outlet.

In another aspect the apparatus further comprises a pipe in fluid communication with the dry crude outlet and the wet crude oil inlet.

In one embodiment of the apparatus the flashing section further comprises a condensed hydrocarbon inlet.

In a system according to U.S. Pat. No. 5,707,510 there is initially no incentive to heat the oil stream from the treater section into the flash section as the treater section in U.S. Pat. No. 5,707,510 is designed to be large enough to allow for sufficient separation of water from the oil that the remaining small portion of water in the oil stream from the treater section will evaporate as a result of the depressurization when the oil enters the flash section. The present inventor surprisingly realized that the size of the treater section could be significantly reduced by allowing some what higher water content in the oil stream leaving the treater section then what the latent heat in the oil is able to evaporate. Further the present inventor realized that the increased water fraction in the oil stream from the treater section could be evaporated with the heat from the separated water. Accordingly the inventor surprisingly found that a first water stream could be heated utilizing a second water stream although both water streams come from the same process. This can be achieved because the increased water content in the oil stream from the treater results in a temperature drop over the flashing valve and due to this temperature drop over the flashing valve the water from the treater section can provide the energy to evaporate the increased water in the oil from the treater section after the oil stream has past the flashing valve. The stream leaving the flashing valve and entering the heat exchanger will with an increased water content be a mixture of oil, liquid water and water vapour at a lower pressure than the water leaving the treater section. The oil stream it self does not comprise enough energy to provide for the full evaporation of the water fraction. The heat exchanger transfers the energy needed to evaporate the water remaining in liquid phase after having passed the flashing valve.

BRIEF DESCRIPTION OF THE DRAWINGS

The present invention is illustrated by the included drawing.

FIG. 1 is a schematic view of an embodiment of the present invention.

PRINCIPAL DESCRIPTION OF THE INVENTION

The present invention will now be discussed in further detail with reference to the enclosed FIG. 1. The system of the present invention comprises a casing means or vessel having an inlet treating section or treater 7 that receives a raw crude oil fluid from an inlet 101 through a line 102. The fluid entering the treating section is a mixture of oil, water, gas, and solids. The treating section 7 operates at pressures from 1.72 barg up to 6.9 barg or more and at temperatures of 120° C. up to 140° C. The treating section 7 has one or more fired U tube heaters 17 that can heat the inlet crude oil up to these operating temperatures. Inside the treating section 7 the majority of the water, gas, and solids are removed by gravity. The separated gas is discharged from the vessel via outlet 32, outlet line 106, and control valve 105. The separated water is discharged from the vessel via outlet 52, outlet line 131, cooler 132, control valve 133 and line 134. Solids that settle to the bottom of the vessel are removed by a sand jetting and desanding system. Jetting water enters the vessel at multiple inlets (not shown) and sand slurry is removed from the vessel at multiple outlets (not shown).

The partially dehydrated crude oil leaving the treating section 7 can contain 5 volume % or more water depending on the water contained in the slop oil entering the treating section. The partially dehydrated crude oil is separated in the flash or flashing section 9. The crude exits the treating section 7 via outlet 58, passes through control valve 107. Thereafter the partially dehydrated oil is heated through heat exchange with the separated water in cooler 132. Do to the high water content in the raw crude the water stream is considerable and so is the heat energy contained therein. The heated crude then proceeds via line 108' and through inlet 59 to the flash section 9. The flash section 9 operates at near atmospheric pressure. A portion of the sensible heat of the hot crude/water mixture is converted to latent heat of vaporization that turns the water into vapour as the mixture de-pressurizes across the control valve 107. The crude/water mixture cools as the energy is absorbed by the vaporizing water. The amount of temperature reduction depends on the amount of water evaporated. The operating temperature of the flash section 9 is lower than the treating section 7 but is still above the boiling point of water.

During this flashing process a certain amount of low boiling point hydrocarbons are also flashed with the water. These low boiling point hydrocarbons are components of the crude oil and are also vaporized by the pressure reduction and the sensible energy of the mixture.

The fluid entering the flash section 9 at inlet 59 is crude oil, water vapour, and light hydrocarbon vapour.

The flash section 9 is a separator where a water vapour and hydrocarbon vapour mixture exits from the top through an outlet 76. The vapours travel through a line 109 to a condenser 110 where the vapours cool. Condensed water, hydrocarbon, and some non-condensable gases enter a separator vessel 111 where the fluids separate by gravity. Non-condensable gases exit from the top of the separator 111 via a line 112 while the water is pumped from the bottom through a line 117 by a pump 118 and discharged to tank via a line 119. The light hydrocarbon liquid is withdrawn from the separator 111 from the zone just above the water zone through a line 113 which leads to a pump 114. A portion of the light hydrocarbon liquid can be routed from pump 114 via a line 115 to a line 120 and through control valve 116 back to the flash section 9 where it enters by an inlet 81. The remainder of the light hydrocarbon liquid is discharged through the line 115 to storage.

The light hydrocarbon that recycles back to the flash section 9 flows through an internal pipe with nozzles that direct the liquid downward counter current to the vapour flow from inlet 59. The light hydrocarbon mixes with the crude oil and aids in breaking down the foam inside the flash section 9. This assists the separation of vapour from the crude oil.

Dry, hot crude oil is pumped from the bottom of the flash section 9 through an outlet 80 via a line 121. A pump 122 transfers most of the crude through a line 123, a cooler 125, and a line 126 to tankage. A portion of the hot crude oil pumped by pump 122 is recycled via a line 127. The recycled hot oil flows to two different places. Some of the recycled oil flows back into the flash section via a line 130, through a valve 129, and via line 128 where it enters the bottom of the vessel by an inlet 82. This recycled stream of oil flows through an internal pipe 85 and discharges through nozzles directed towards the bottom of the flash section. This maintains circulation in the flash section bottom to keep solids in suspension and prevent them from plugging the oil outlet 80.

The second recycled stream of hot oil flows through line 127 to a valve 135, and then through line 136 back to the inlet line 102 which flows to the treating section 7 inlet. The recycled, dry crude oil from the flash section mixes with the raw inlet crude oil. Within the treating section 7 the recycled oil is heated by the fired U tube 17 along with the incoming raw crude. The recycled oil makes its way through the treating section 7, through the pressure reducing control valve 107, and into the flash section 9 again. In this way the heating means in the treating section 7 provides all of the heat required for the flash section 9 to operate. By adding the mass of dry recycled oil, additional heat can be transferred to the oil/water mixture by the fire tube in the treating section and that which flashes across the control valve 107. This increases the capacity of the unit to vaporize additional water, which is especially important when short term upset conditions occur in the front treating section 7.

By feeding some of the recycled oil to the bottom of the flash section 9, through inlet 82, oil in the flash section 9 will be kept warm during no inlet flow conditions. If the unit is shut down for short periods of time the treating section heater can be used to maintain the crude oil at operating temperatures by recycling a small volume of the dry crude from the bottom of the flash section 9 back to the treating section 7 as described above.

The improvement of the present invention includes use of heat in the high amount of water discharged from the treating section to reduce the total heat input by fire tube 17 and keep the temperature of the water content in crude/oil downstream control valve 107 higher than its boiling point. As previously explained, the amount of temperature reduction in the partially dehydrated slop oil/rag as it flashes across the control valve 107, depends on the amount of water in it; higher residual water content in the partially dehydrated slop oil/rag means higher operating temperatures and pressures are required in the treating section to keep high mixture temperature after control valve 107. To minimize this heat duty, the sensible heat of the hot water exiting the treater section is used to add additional heat to the partially dehydrated slop oil/rag after the mixture is depressurized across the control valve 107. The outlet line 108 is fed to the cooler 132 where it is heated completing vaporisation of the water in the crude oil before being feed to inlet 59 in the flash section 9.

The invention claimed is:

1. Apparatus for treating crude oil comprising:

a treating section comprising a wet crude oil inlet, a gas outlet, a water outlet, a partially dry crude outlet and at least one fired heater tube;

a flashing section without heating means comprising a partially dry crude inlet, a dry crude outlet, and a vapor outlet;

a flashing valve and a heat exchanger arranged on a pipe connecting the partially dry crude outlet with the partially dry crude inlet, wherein the heat exchanger is arranged downstream of the flashing valve, and wherein said water outlet is in fluid communication with said heat exchanger for heat exchange with partially dry crude oil.

2. The apparatus according to claim 1, wherein the apparatus further comprises a pipe in fluid communication with the dry crude outlet and the wet crude oil inlet.

3. The apparatus according to claim 1, wherein the flashing section further comprises a condensed hydrocarbon inlet.

4. The apparatus according to claim 1, wherein the flashing section further comprises a dry crude recycle inlet in fluid communication with the dry crude outlet.

5. The apparatus according to claim 4, wherein the apparatus further comprises a pipe in fluid communication with the dry crude outlet and the wet crude oil inlet.

* * * * *